United States Patent [19]

Tone

[11] Patent Number: 5,034,724

[45] Date of Patent: Jul. 23, 1991

[54] ALARM DEVICE FOR WALLETS AND THE LIKE

[76] Inventor: James D. Tone, Upr 11 Rose St., Kitchener, Ontario, Canada, N2H 1L5

[21] Appl. No.: 302,239

[22] Filed: Jan. 26, 1989

[30] Foreign Application Priority Data

Jan. 28, 1988 [CA] Canada ..... 557545

[51] Int. Cl.[5] ..... G08B 13/14

[52] U.S. Cl. ..... 340/571; 200/61.19

[58] Field of Search ..... 340/571, 572, 568; 200/61.19

[56] References Cited

U.S. PATENT DOCUMENTS 4,480,250 10/1984 McNeely ..... 340/568

4,652,865 3/1987 Maharshak ..... 340/568

4,692,745 9/1987 Simanowitz ..... 340/571

4,721,948 1/1988 Lin ..... 340/568

4,794,378 12/1988 Chen et al. ..... 340/571

*Primary Examiner*—Joseph A. Orsino

*Assistant Examiner*—Frank M. Scutch, III

*Attorney, Agent, or Firm*—Anthony Asquith & Co.

[57] ABSTRACT

A wallet is disclosed which incorporates an electrical alarm circuit for signalling that e.g. a credit card has not been properly returned to its compartment in the wallet. The electrical current is transferred from compartment to compartment, and from the battery and buzzer portion, by means of contact pads and zones which come together when the wallet is closed. The need to conduct electricity through the hinge area is eliminated.

9 Claims, 4 Drawing Sheets

ALARM DEVICE FOR WALLETS AND THE LIKE

This invention is applicable to the storage of a number of items together, the items being stored separately, each in a respective compartment. The invention relates to a manner of providing an alarm or alert, in the event that one of the items has not been properly replaced in its compartment.

The invention is particularly applicable to the storage of credit cards and the like in a wallet, but the invention may be applied to other forms of storage, as will be explained.

BACKGROUND TO THE INVENTION

It is a common practice for such items as credit cards, driver's licence, and the like, to be kept in a wallet. Often, the wallet is so constructed as to provide a separate respective pocket for each item. Typically, a wallet might contain 8 or 10 such pockets.

It is all too easy for the owner of the wallet, after making a purchase with a credit card for example, to forget to return the card to its compartment in the wallet. He might pick up the card and place the card loose in another pocket, or, worse still, he might leave the card behind.

The aim of the invention is to provide a device which will alert the owner of the wallet to the fact that one of the cards has not been properly replaced in its compartment.

THE PRIOR ART

There have been a number of previous proposals of wallets which incorporate battery-operated alarms to warn that a credit card has not been replaced. Some use the principle that when the wallet is open and unfolded, the alarm circuit is disabled, and the cards may be removed at that time without setting off the alarm signal. But when the wallet is closed up, ready to be replaced in the pocket, the alarm circuit is re-activated.

U.S. Pat. No. 4,692,745 (SIMANOWITZ, Dec. 1985) uses a photo-electric means to activate the alarm circuit when the wallet is closed.

In U.S. Pat. No. 4,480,250 (MCNEELY, Oct. 1984) the electrical contacts which sense the presence or absence of the respective credit cards, are formed as printed circuits.

U.S. Pat. No. 4,652,865 (MAHARSHAK, Mar. 1987) shows the use of contact strips extending from compartment to compartment.

GENERAL DESCRIPTION OF THE INVENTION

It is recognised in the invention that, in order to find favour with the public, an alarm device for a wallet should possess most or all of the following qualities:

1. The device should provide a convenient method of forcing the owner to place the card back in its proper place. The device will not find favour with the public if it requires the owner to take steps over and above simply replacing the card in the wallet.

2. The device should not use batteries up more quickly than the owner expects batteries to last.

3. The alarm signal the device provides should be discrete, yet readily discernable, and preferably should be an audible buzzer.

4. The device should not produce false alarms, and yet should give a reliable signal when required to do so.

5. The device should continue to operate reliably over a long service life. In particular, since a wallet is folded and unfolded many times, the device should not tend to be weakened, either in structure or in operation, by such repeated flexing.

6. The device should be inexpensive to manufacture, and to assemble into the wallet, whether as a separate add-on unit, or as a built-in unit.

7. Since wallets are normally kept in a person's pocket, the device should be, generally, not at all bulky or cumbersome. The device should be light in weight and small in size, and particularly the device should not add appreciably to the thickness of the wallet.

8. The device should not be restricted to a specific number of compartments. The owner should be able to select whatever number of compartments suits him, and he should be able, without difficulty, later to add to, or subtract from, that number of compartments.

9. The device should easily permit the owner to test the battery and the operation of the circuit.

It is an aim of the invention to bring all these attributes together in an alarm device more effectively than has been the case in the devices shown in the prior art.

The device of the invention includes at least one compartment for receiving and containing the credit card or other item. The compartment is provided with electrically conducting strips which are normally held apart by the credit card, but which make electrical contact when the card is not present within the compartment. The strips are connected each to a respective contact zone, provided on the compartment. The device of the invention also includes an alarm portion, in which is housed a battery and a signalling device such as a buzzer. The alarm portion also includes a pair of contact pads, and the battery and the buzzer are connected together in series between the pads. The pads are electrically separated, so that the components within the alarm portion do not by themselves form an electrically complete circuit.

The contact zones on the compartment, and the contact pads on the alarm portion, are arranged to face each other, so that when the wallet is closed, and the alarm portion and compartment are together, the pads touch the zones. The alarm circuit is therefore made if there is no card present, but remains open if there is a card present.

One main advantage of this arrangement of pads and contact zones is that it eliminates the need for passing electrical current through the hinge area of the wallet. It was this need which meant that in previous desingns the electrical conductor had either to flex or to pivot in some way at the hinge area. As a result, the device either quickly deteriorated in reliability or was inordinately expensive.

By way of further explanation of the invention, an examplary embodiment of the invention will now be described.

DETAILED DESCRIPTION OF PREFERRED EMBODIMENT

Figure 1:
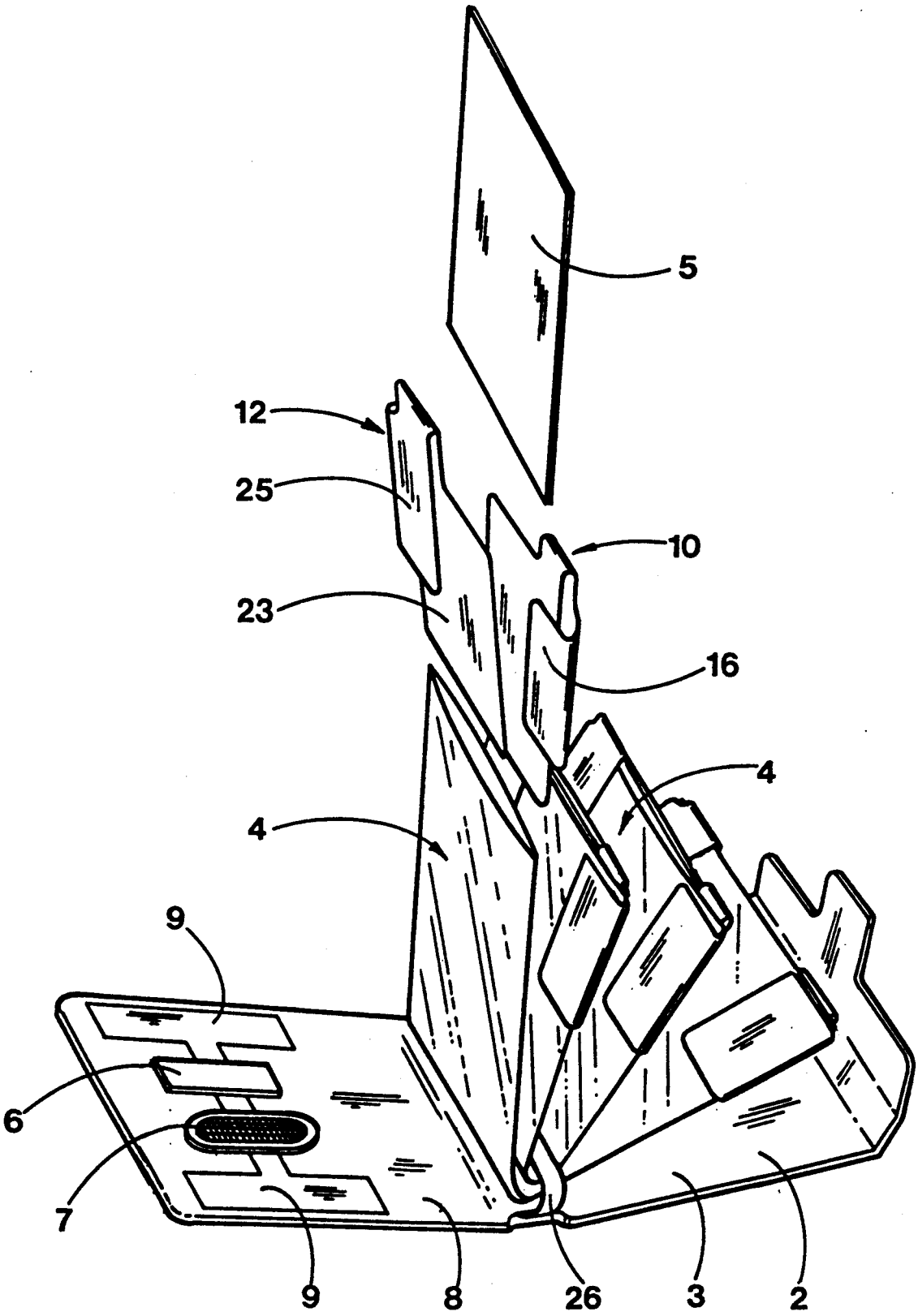
FIG. 1 is a pictorial view showing a wallet with an alarm device, which embodies the invention.

The wallet 2 shown in the drawings comprises an outer cover 3 and a number of compartments 4. Four compartments 4 are shown, but the number may be changed, as appropriate.

Each compartment 4 has opposed walls, between which is received a credit card 5, or a similar item of the same size and shape, such as driver's documentation or an identity card.

The owner of the wallet may remove the credit card etc 5 from its respective compartment 4, while carrying out a transaction. The owner's intention of course is that he will replace the card in its compartment when the transaction is completed, and it is to alert the owner to the fact that he has not done so that the alarm device of the present invention is incorporated into the wallet.

The alarm device is electrically operated, and includes a battery 6 and an alarm buzzer 7. In the particular version shown, these components are permanently attached to the flap 8 of the outer cover 3, and the electrical connections between them are built into the structure of the flap 8 of the wallet 2.

Figure 3:
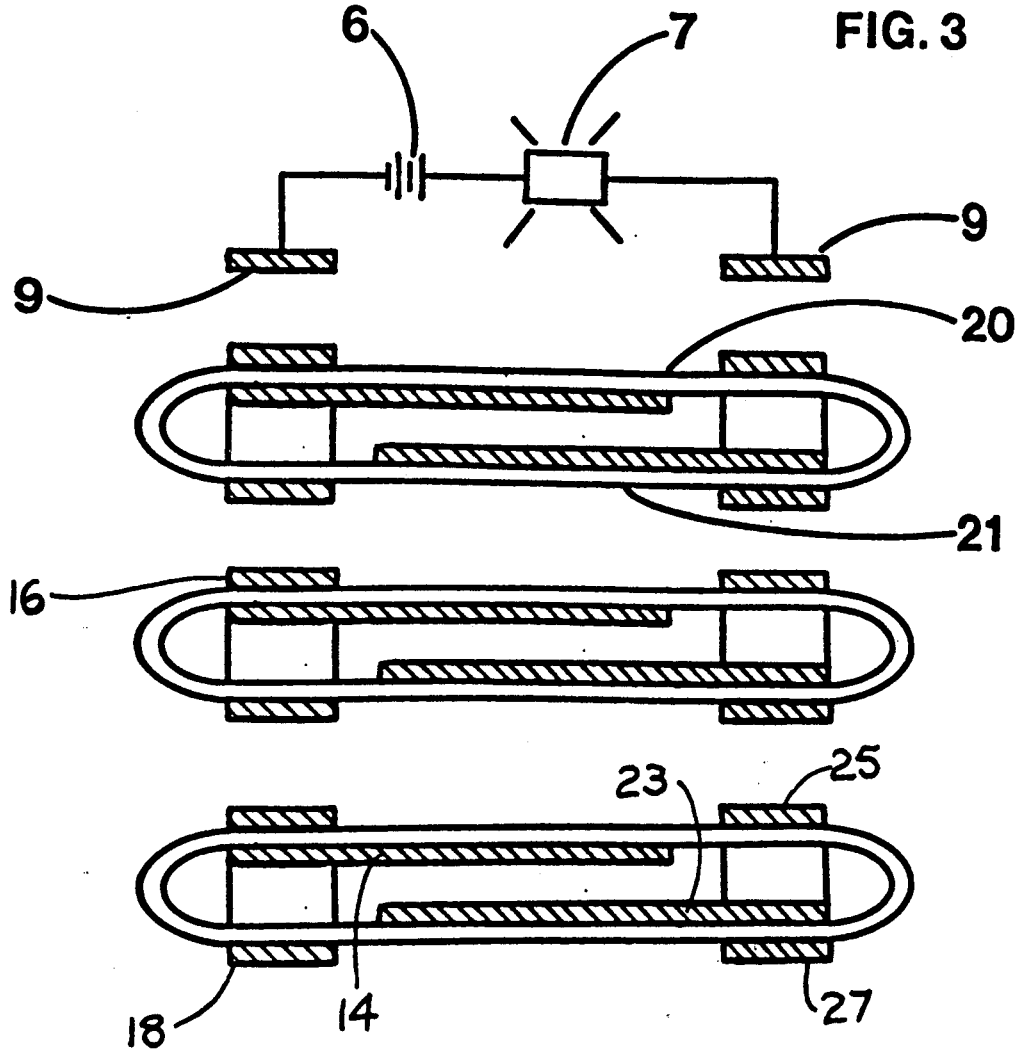
FIG. 3 is a diagrammatic view showing some details of the electrical circuit of the wallet of FIG. 1.
Figure 2:
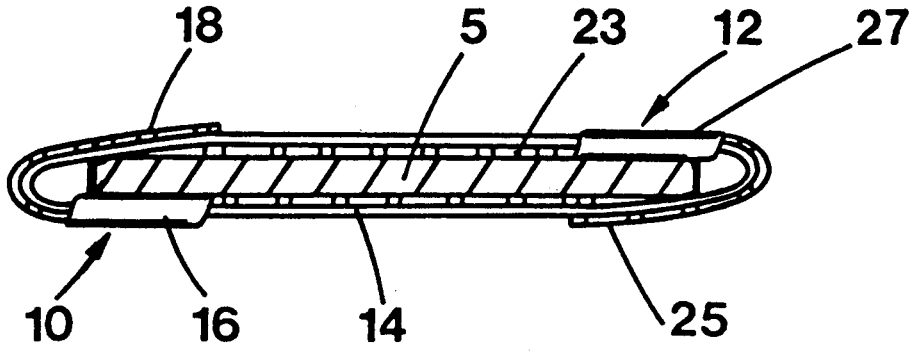
FIG. 2 is a cross-section of a compartment of the wallet of FIG. 1.

The electrical circuit is shown in FIG. 3. The flap 8 is provided with two electrical contact pads 9, which are connected electrically to the battery and buzzer as shown in FIG. 3. The flap 8 comprises the alarm portion which is an essential feature of the invention.

Figure 4:
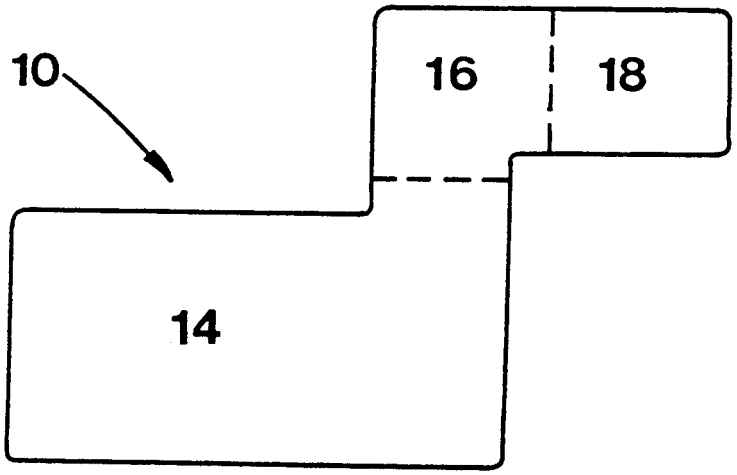
FIG. 4 is a plan view of a component of the wallet of FIG. 1.

Each compartment 4 is equipped with two strips 10,12. The strip 10 is shaped as shown in FIG. 4. The shape of the strip includes a card contact zone 14, a front pad zone 16 and a rear pad zone 18. The strip is folded in the manner shown in the drawings, and is glued into the compartment 4 as shown. The strip 10 is made of metallic (i.e. electrically conductive) foil.

The strip 12 is identical, having a card contact zone 23, and two pad zones 25, 27. When the strip 12 is inserted into the compartment, zone 25 is the front zone and zone 27 is the rear zone.

When the wallet is closed, the contact pads 9 are in contact with the corresponding front zones 16, 25 of the strips 10, 12 in the next adjacent one of the compartments 4. Similarly, the rear contact zones 14, 27 of the strips 10, 12 are in contact with the front zones of the strips of the next compartment.

The buzzer 7 will sound, if the pair of strips of any one of the compartments are in contact. It is arranged that a credit card that is positioned properly within the compartment will hold the strips apart, and prevent electrical contact between the card contact zones 14. But if a card is not present in any one of the compartments, the buzzer will sound.

When the wallet is open, on the other hand, the pads 9 on the flap 8 fall clear of the contact zones 16, 25 of the next adjacent compartment. This separation disables the buzzer, and allows the cards to be removed from the compartments without the alarm being sounded.

In the wallet shown, the separate compartments may be attached into the wallet by welding, but preferably are attached by means of a clip 26. The use of such a clip is common in wallets with compartments. The clip is built into the structure of the outer cover 3. The compartments are formed simply as flat tubes, which are each folded along the line of the clip to create a pair of compartments. The advantage of the clip construction is that pairs of compartments can be readily added to, or taken out of, the wallet.

With the clip construction, there is no need for a hinge as such, ie in the form of a specific hinge component, neither for the compartments nor for the outer cover. In the invention, it is recognised that there is no requirement either for a means to be found for transmitting electrical current through the hinge area.

It should be noted that it is quite difficult to provide a means for transmitting electrical current through a hinge. If an electrical conductor were to be arranged to flex as the wallet is opened and closed, the service life of the conductor would be quite short, because the conductor would tend to be weakened by flexing. It may be said that there is no simple, inexpensive, way of conducting electricity through a hinge.

In the invention, the need to transmit electricity through the hinge area has been eliminated. In the invention, none of the electrically conducting components of the wallet are required to flex or bend, nor indeed to move in any way.

In the invention, the electrical contact zones 18, 27 are arranged to touch against the zones of neighbouring compartments when the wallet is closed. Each compartment is thereby provided, when the wallet is closed, with an applied voltage difference between the two strips.

It is necessary that a good electrical contact be maintained between the pads. A marginal strip of foam rubber may be built into the flap 8, underneath the pads 9, to provide some resilience under the pads, to ensure that the pads are squeezed gently together, although the resilience of the wallet itself is usually sufficient.

Figure 5:
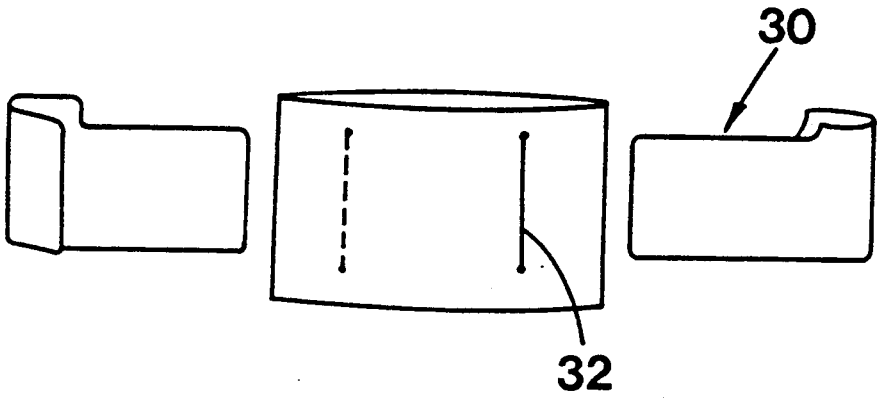
FIG. 5 is a pictorial view of an alternative manner of constructing a compartment for the wallet of FIG. 1.

FIG. 5 shows an alternative manner of placing the electrical strips in the compartments. Here, the strips 30 are passed through respective slits 32 in the walls of the compartment. Again, the strips may be glued in place once inserted.

Figure 6:
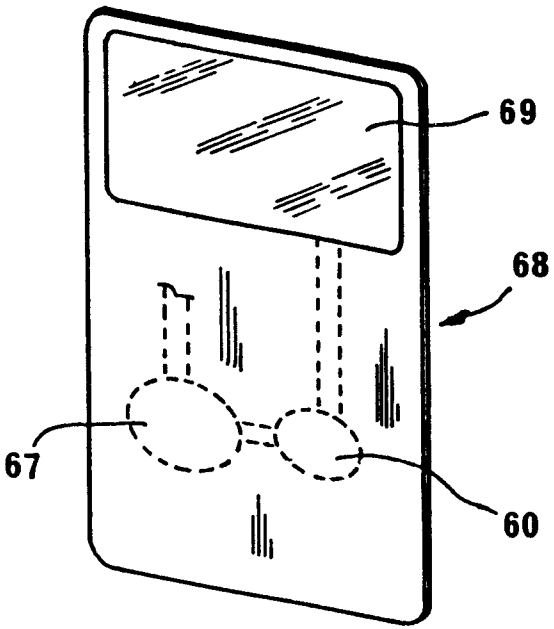
FIG. 6 is a view showing a component of an alternative alarm device.

In an alternative construction of the alarm device of the invention, as shown in FIG. 6, the buzzer 60 and battery 67, rather than being built into the flap 8 of the outer cover 3 of the wallet, may be built into an alarm-card 68. The alarm-card 68 is dimensioned like a credit card, and is intended to fit inside one of the several compartments 4 provided in the wallet. When the card 68 is thus placed, the rest of the compartments are activated by the alarm-card.

The broken lines in FIG. 6 show the outlines of the buzzer and battery, and their electrical connections. These components are embedded in plastic material of the alarm-card 68. The electrical contact pads 69 (one each side of the card) of course are exposed on the surface of the card.

The alarm-card 68 may be completely separable from the compartment or from the wallet, as shown, so that the alarm-card may be separately purchased, and separately replaced, if desired.

Figure 7:
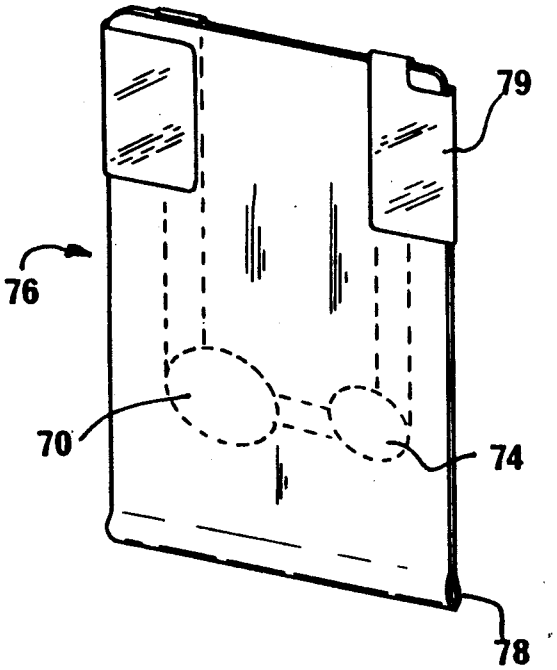
FIG. 7 is a view showing a component of another alternative alarm device.

In another alternative construction of the alarm device of the invention, as shown in FIG. 7, the buzzer 70 and battery 74 are located in a sandwich 76 between sheets of plastic. The sandwich 76 may be formed by folding a single sheet in such a way as to leave a loop 78, which is arranged to co-operate with the clip 26 to retain the sandwich 76 in the wallet. The sheets of plastic are welded together, the components being trapped between the sheets. Again, the broken lines indicate the presence of the electrical elements and their connections.

The contact pads 79 of the sandwich 76 of FIG. 7 are arranged to make contact with the outside zones 16, 18, 25, 27 of the adjacent compartments 4, whereas the contact pads 69 of the alarm-card 68 of FIG. 6 are arranged to make contact with the inside strips 14, 23.

In a variation (not shown) of the FIG. 7 construction, the sheets of plastic material may be arranged to form compartments as in FIG. 1; the electrical elements may be incorporated in one limb of the compartment, leaving the other limb available to accept a credit card.

Such separable alarm portions as are shown in FIGS. 6 and 7 may be installed in any suitable wallet, along with a number of the compartments 4; the invention may be applied therefore to converting an existing non-alerting wallet into an alarm wallet, without modification to the wallet. In any case, when it is desired not to compromise the design or manufacture of the wallet itself by considerations of electrical alarms and circuits, it would be preferred for the alarm portion to be a separately manufactured item.

It will be noted that, in the invention, the number of compartments may be increased very readily. It is not necessary to modify the existing compartments in any way when more are added. Each compartment is coupled into the alarm circuit simply by contact with the next compartment.

The owner of the wallet may test the alarm circuit very easily, simply by omitting one of the credit cards deliberately, and closing the wallet. There are no switches or other contacts to be operated consciously. The device of the invention is fully automatic in operation. Although the alarm device of the invention has been described in relation to wallets, the device may be used with other compartmentalized storage systems, such as files that are stored in compartments in a drawer. Thus, the device can be used to indicate that a file is missing from its compartment when the drawer is closed.

I claim:

1. Alarm device for use with an openable and closable container having at least one compartment for receiving an item to be stored in the container, the device being arranged to provide a signal when the item is missing from the compartment, wherein:

the device includes an alarm portion;

the alarm portion includes a pair of contact pads;

the alarm portion includes a source of electrical energy, and an indicating means;

the source and the indicating means are connected together electrically in series to, and between, the contact pads;

the compartment includes a pair of strips made of conducting material;

the device includes a means which is effective, when the container is closed, to urge the strips towards each other and into electrical contact;

the arrangement of the compartment and the strips is such that the strips are held electrically apart by the presence of the item within the compartment;

the arrangement of the device is such that when the container is closed the compartment and the alarm portion lie close together, and when the container is open the compartment and the alarm portion lie spaced apart;

the compartment includes a pair of electrical contact zones;

the contact zones are electrically separate from each other, and the strips are connected electrically each to a respective one of the zones, each zone and its associated strip together comprising a respective electrical region;

and the contact zones are so positioned on the compartment, and the pads are so positioned on the alarm portion, that when the container is closed the pads lie in electrical contact each with a respective one of the regions, and that when the container is open the regions on the compartment are electrically separated from the pads on the alarm portion.

2. Device of claim 1, wherein the said strips lie on inside surfaces of the compartment, and the said zones lie on outside surfaces of the compartment.

3. Device of claim 2, wherein the container is a wallet.

4. Device of claim 3, wherein the alarm portion is separable from the remainder of the wallet.

5. Device of claim 3, wherein:

the alarm portion is in the form of a sandwich, and the source of electrical energy and the indicating means are mounted in the sandwich;

the sandwich has corresponding dimensions to the compartment, and is suitable for mounting in the wallet alongside and adjacent to the compartment;

and the contact pads of the sandwich are so arranged as to make electrical contact directly with the said zones on the outside of the compartment.

6. Alarm device for use with an openable and closable container having at least one compartment for receiving an item to be stored in the container, the device being arranged to provide a signal when the item is missing from the compartment, wherein:

the device includes an alarm portion;

the alarm portion includes a pair of contact pads;

the alarm portion includes a source of electrical energy, and an indicating means;

the source and the indicating means are connected together electrically in series to, and between, the contact pads;

the compartment includes a pair of strips made of conducting material;

the device includes a means which is effective, when the container is closed, to urge the strips towards each other and into electrical contact;

the arrangement of the compartment and the strips is such that the strips are held electrically apart by the presence of the item within the compartment;

the arrangement of the device is such that when the container is closed the compartment and the alarm portion lie close together, and when the container is open the compartment and the alarm portion lie spaced apart;

the compartment includes a pair of electrical contact zones;

the contact zones are electrically separate from each other, and the strips are connected electrically each to a respective one of the zones, each zone and its associated strip together comprising a respective electrical region;

and the contact zones are so positioned on the compartment, and the pads are so positioned on the alarm portion, that when the container is closed the pads lie in electrical contact each with a respective one of the regions, and that when the container is open the regions on the compartment are electrically separated from the pads on the alarm portion;

the said strips lie on inside surfaces of the compartment, and the said zones lie on outside surfaces of the compartment;

the container is a wallet;

the alarm portion is in the form of an alarm-card, and the source of electrical energy and the indicating means are mounted in the alarm-card;

the wallet includes more than one of the said compartments, and the alarm-card is so dimensioned as to fit inside one of the compartments;

and the contact pads of the alarm-card are so arranged as to make electrical contact directly with the said contact strips inside that compartment.

7. Device of claim 1, wherein:

the compartment comprises a front wall and a back wall, so arranged as to receive the item therebetween, each wall having an inside and an outside;

the two strips are positioned respectively on the insides of the front and back walls, one inside each wall of the compartment;

the strips are arranged on the walls of the compartment to face each other, whereby the strips may touch each other, and make electrical contact, if the item is not present in the compartment, and whereby the strips are held separated by the item when the item is present in the compartment;

and the two contact zones are positioned on the outsides of the front wall.

8. Device of claim 7, wherein the two contact zones are positioned one to the left and one to the right of the outside of the front wall.

9. Device of claim 8, wherein the two contact zones each extend around the compartment to the outside of the back wall.

* * * * *